US006794576B1

(12) United States Patent
Justason et al.

(10) Patent No.: US 6,794,576 B1
(45) Date of Patent: Sep. 21, 2004

(54) POWER ENTRY APPARATUS AND METHOD

(75) Inventors: Eric J. Justason, Apex, NC (US); James L. Korzik, Apex, NC (US); Michael J. Harris, Cary, NC (US); Jimmie A. Stutts, Jr., Raleigh, NC (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 10/163,189

(22) Filed: Jun. 4, 2002

(51) Int. Cl.[7] ..... H01R 13/46

(52) U.S. Cl. ..... 174/72 B; 174/53; 174/59; 361/358; 361/356; 361/357

(58) Field of Search ..... 174/72 B, 53, 174/59; 361/358, 356, 357, 552

(56) References Cited

U.S. PATENT DOCUMENTS

| | | | | |
|---|---|---|---|---|
| 3,596,141 A | * | 7/1971 | Jones et al. | 361/664 |
| 3,651,245 A | * | 3/1972 | Moll | 174/51 |
| 5,070,429 A | * | 12/1991 | Skirpan | 361/644 |
| 5,982,596 A | | 11/1999 | Spencer et al. | |
| 6,005,758 A | | 12/1999 | Spencer et al. | |
| 6,157,527 A | | 12/2000 | Spencer et al. | |
| 6,212,049 B1 | | 4/2001 | Spencer et al. | |
| 6,215,681 B1 | | 4/2001 | Schuurman et al. | |

* cited by examiner

*Primary Examiner*—Dean A. Reichard
*Assistant Examiner*—Jinhee Lee
(74) *Attorney, Agent, or Firm*—Baker Botts L.L.P.

(57) ABSTRACT

A power entry apparatus includes a plurality of bus bars and a plurality of conductor terminations. At least one of the plurality of the conductor terminations is mounted to at least one of the plurality of bus bars at a plurality of mounting points. The power entry apparatus also includes a circuit breaker electrically connected to the plurality of bus bars.

20 Claims, 2 Drawing Sheets

POWER ENTRY APPARATUS AND METHOD

TECHNICAL FIELD OF THE INVENTION

This invention relates in general to electrical power systems, and more particularly to a power entry apparatus and method.

BACKGROUND OF THE INVENTION

Various electrical devices are powered by external power sources. A power entry apparatus provides the structure for bringing power from an external power source into the electrical device. As just one example, a communications network may include card rack equipment located in a telephone central office (CO) or other telecommunications facility. The power supplies at COs and similar telecommunication facilities typically provide −48 volts DC ($V_{DC}$). The power entry apparatus must meet all required safety and technical specifications and applicable regulations imposed by the government and industry.

In a conventional power entry apparatus, conductor wires from the external power supply deliver the power and are connected to the power entry apparatus using terminal blocks, ring lugs, or wire ties. The power entry apparatus delivers the power to the electrical device. Unintended movements or vibrations of the electrical device or conductor wires may result in movement of the wire connections. If the wire connections are moved out of the proper position, the power supplied to the electrical device may become unstable. Improperly positioned wire connections also risk short circuiting the conductor wires and may lead to excessive heating or even an equipment fire.

SUMMARY OF THE INVENTION

From the foregoing, it may be appreciated by those skilled in the art that a need has arisen for an interface that can connect an external power supply to an electrical device. In accordance with the present invention, a power entry apparatus is provided that substantially eliminates or greatly reduces disadvantages and problems associated with delivering power from an external power source to an electrical device.

In accordance with one embodiment of the present invention, a power entry apparatus includes a plurality of bus bars and a plurality of conductor terminations, wherein at least one of the plurality of conductor terminations is mounted to at least one of the plurality of bus bars at a plurality of mounting points. The power entry apparatus further includes a circuit breaker electrically connected to the plurality of bus bars.

In accordance with another embodiment of the present invention, a method for providing electrical power includes providing a plurality of bus bars and mounting at least one of a plurality of conductor terminations to at least one of the plurality of bus bars at a plurality of mounting points. The method also includes electrically connecting a circuit breaker to the plurality of bus bars.

In accordance with yet another embodiment of the present invention, a power entry apparatus includes a plurality of bus bars and a plurality of terminal lugs, wherein at least one of the plurality of terminal lugs is mounted to at least one of the plurality of bus bars at a plurality of mounting points. The power entry apparatus also includes a circuit breaker electrically connected to the plurality of bus bars. The power entry apparatus further includes a cover and baseplate made from a non-conductive material.

Important technical advantages of certain embodiments of the present invention include a power entry apparatus that includes a cover that provides a safety shield around power entry apparatus components that conduct electricity, preventing unintended contact with the bus bars and terminal lugs. Other important technical advantages of certain embodiments of the present invention include bus bars that are integrated into a circuit breaker. The spacing of the bus bars is selected to prevent any electrical creepage between the bus bars. Other examples may be readily ascertainable by those skilled in the art from the following figures, description, and claims.

BRIEF DESCRIPTION OF THE DRAWINGS

For a more complete understanding of the present invention and its advantages, reference is now made to the following description, taken in conjunction with the accompanying drawings, in which.

DETAILED DESCRIPTION OF THE INVENTION

Figure 1:
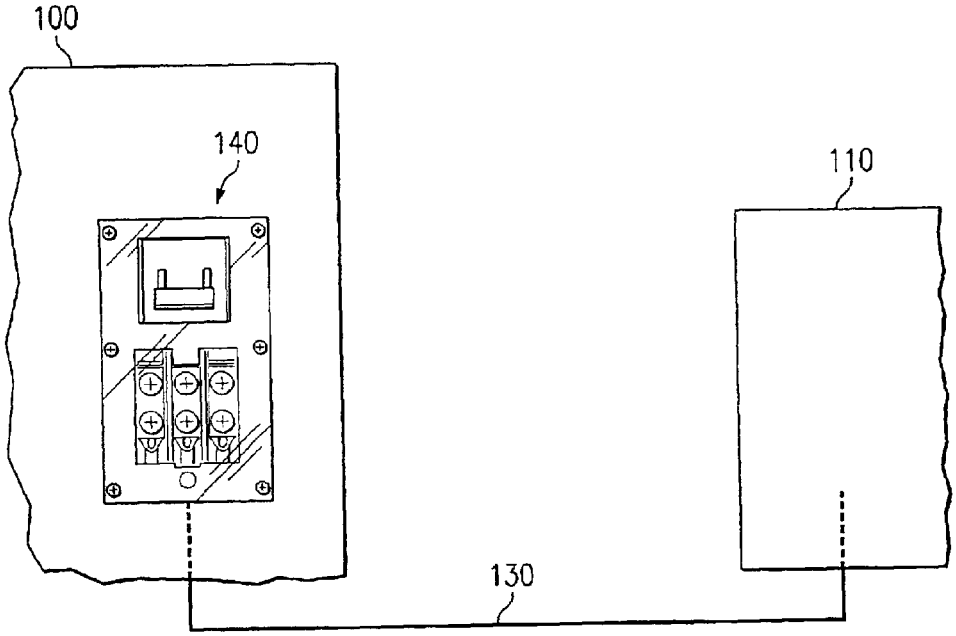
FIG. 1 illustrates an operating environment of one embodiment of a power entry apparatus.

FIG. 1 illustrates an operating environment of a power entry apparatus in one embodiment of the present invention. An electrical device 100 receives electrical power from an external power source 110 across a path 130. Electrical device 100 may be any type of device that uses electrical power. In one embodiment of the present invention, power source 110 is a direct current (DC) power source. However, it is envisioned that in other embodiments power source 110 may also be operable to provide alternating current (AC) power. Path 130 originates at power source 110 and it terminates at a power entry apparatus 140 of device 100. In one embodiment of the present invention, path 130 is comprised of a number of wires or other electrical conductors. To deliver DC power from power source 110 to electrical device 100, path 130 may include a wire conductor for a positive DC connection, a wire conductor for a negative DC connection, and a wire conductor for a ground path. In other embodiments, other types and numbers of conductors in path 130 are envisioned as also within the scope of the present invention.

By way of example, electrical device 100 may be a communications device located in a telephone central office. In this example power supply 110 provides −48 volts DC power to electrical device 100 from power source 110 across the positive, negative, and ground conductor wires of path 130. The conductor wires terminate at power entry apparatus 140. Power entry apparatus 140 is operable to receive power from power supply 110 and deliver it to electrical device 100.

Figure 2:
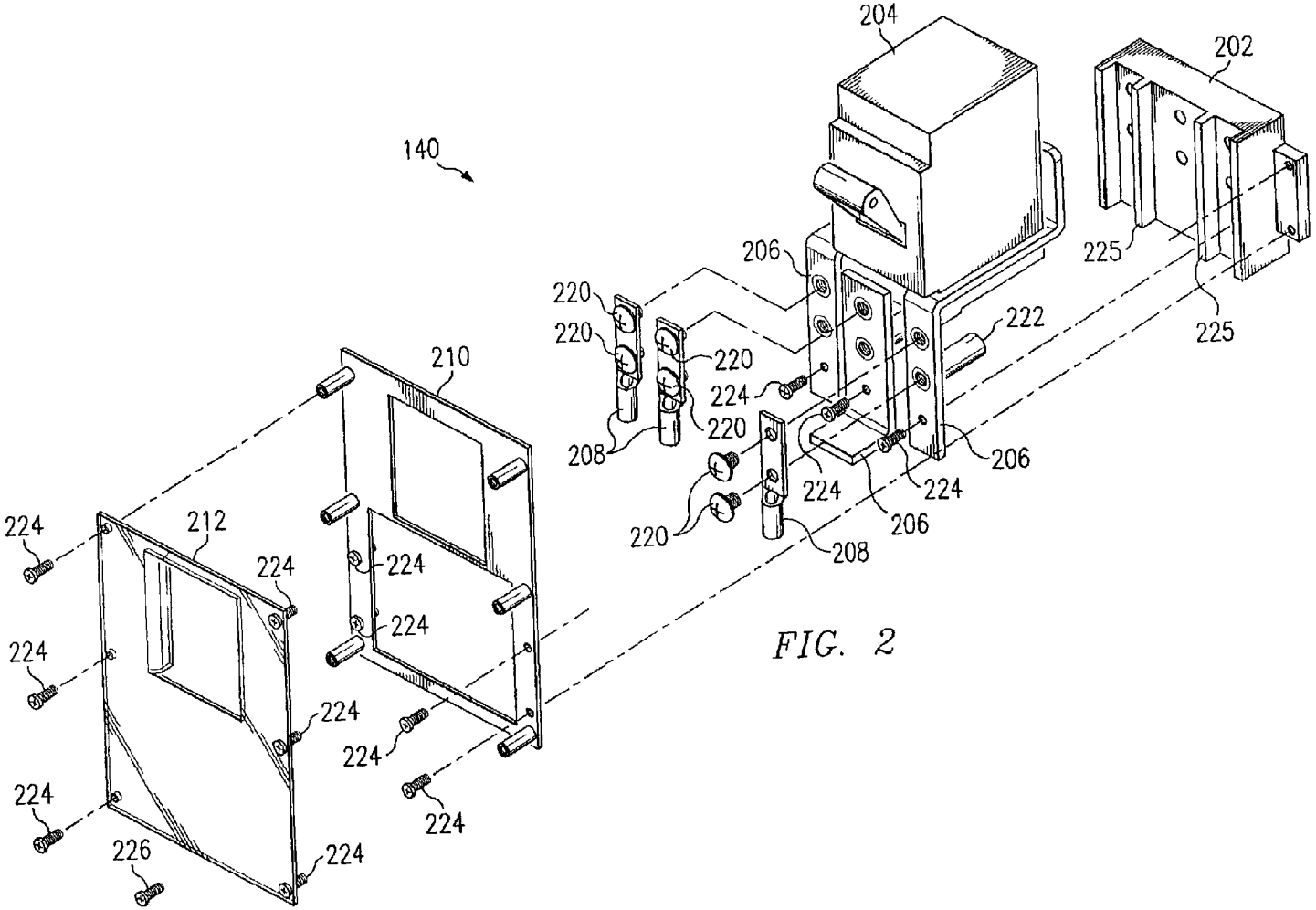
FIG. 2 illustrates an exploded view of a power entry apparatus in one embodiment of the present invention.

FIG. 2 shows one embodiment of power entry apparatus 140 in greater detail. In the illustrated embodiment power entry apparatus 140 includes conductor terminations 208, bus bars 206, a circuit breaker. 204, a face plate 210, a base plate 202, and a cover 212.

The conductors of electrical path 130 are terminated at conductor terminations 208 in power entry apparatus 140. In one embodiment of the present invention, conductor terminations 208 are terminal lugs. In the illustrated embodiment, conductor terminations 208 are two-hole, standard barrel terminal lugs. For purposes of convenience, conductor terminations 208 will be described below as terminal lugs 208 but other types of conductor terminations are within the scope of the present invention. Terminal lugs 208 are crimp-style connectors that are in full compliance with the May 2001 SBC Equipment Requirements TP76200MP standard for conductors of size #16 American Wire Gauge (AWG) or greater. Other types of terminal lugs 208 are envisioned as also within the scope of the present invention. Terminal lugs 208 are rated by the Underwriters Laboratory (UL) and meet all required safety standards and appropriate electrical code requirements. Terminal lugs 208 may be made from various conductive materials. In one embodiment, terminal lugs 208 are made from the same conductive material as the conductive material in the conductors of path 130.

Each terminal lug 208 may be mounted to bus bar 206 at multiple connection points. Mounting terminal lug 208 to bus bar 206 at multiple connection points achieves a sturdy and secure attachment. Unintended movements of electrical device 100, power entry apparatus 140, or the conductors of path 130 are less likely to result in movement at the connection of terminal lug 208 to bus bar 206 when terminal lug 208 and bus bar 206 are connected at multiple connection points. In a conventional power entry apparatus, where a conductor from path 130 is connected to a bus bar at a single mounting point, the unintended movement of electrical device 100, the conventional power entry apparatus, or the conductors of path 130 is more likely to result in movement at the connection point. Of particular concern is any rotating movement of the conductors that moves the conductors closer together or even causes one conductor to contact another conductor. Rotating movement at the connection point risks an electrical short circuit of the conductors. A short circuit may cause electrical device 100 to function improperly or cease to function at all. A short circuit of the conductors may also generate excess heat or cause a fire, resulting in damage to electrical device 100 and its surroundings. If the conductors are too close to each other, electrical creepage may result. Creepage may interfere with the proper operation of electrical device 100 and will be discussed below in greater detail.

In the illustrated embodiment of the present invention, terminal lugs 208 contain multiple holes to permit connection to bus bars 206. By connecting terminal lugs 208 to bus bars 206 at multiple points, the unintended rotation of the power conductors of electrical path 130 and terminal lugs 208 may be avoided. In one embodiment, the holes are spaced at either one-half inch (½") or five-eighths inch (⅝") on center. These dimensions are in accord with telecommunications specifications such as the May 2001 SBC Equipment Requirements set forth in TP76200MP. Where electrical device 100 is located in a telephone central office or other facility, the requirements of all appropriate telecommunication specifications must be met.

In the illustrated embodiment, terminal lugs 208 are connected to bus bars 206 by mounting screws 220. A mounting screw 220 passes through a hole in terminal lug 208 and a corresponding hole in bus bar 206, and mounting screw 220 is screwed into a standoff 222. Standoff 222 may be internally threaded to receive mounting screw 220. In one embodiment, mounting screw 220 is long enough to pass through terminal lug 208, bus bar 206, be threaded into standoff 222, and extend from standoff 222 to permit mounting screw to be screwed into a hold in base plate 202. In another embodiment, the hole in bus bar 206 is internally threaded to receive mounting screw 220 and standoff 222 may or may not be included in power entry apparatus 140. Each terminal lug 208 is rigidly connected to bus bar 206 by two mounting screws 220. Other embodiments are envisioned using different methods of connecting terminal lugs 208 to bus bars 206 at multiple mounting points and these embodiments are also within the scope of the present invention.

Bus bars 206 may be made from any material that functions as an electrical conductor. Example materials that provide electrical conductivity include, but are not limited to, aluminum and copper. Bus bars 206 may be in any shape, size, or configuration that is operable to meet the current and voltage requirements of electrical device 100. In one embodiment of the present invention, bus bars 206 are integrated into circuit breaker 204. In this embodiment, bus bars 206 are directly connected to the power inputs (not shown) of circuit breaker 204, eliminating the need for additional electrical connections between bus bars 206 and the power inputs of circuit breaker 204. In other embodiments, however, electrical power on bus bars 206 is delivered to circuit breaker 204 by additional connections between bus bars 206 and the power inputs of circuit breaker 204. The size of bus bars 206 may be selected according to the current and voltage needs of electrical device 100 or the configuration of circuit breaker 204. In another embodiment, bus bars 206 of power entry apparatus 140 interface directly and securely with a circuit breaker of electrical device 100. In this embodiment, circuit breaker 204 within power entry apparatus 140 is not necessary. Because terminal lugs 208, bus bars 206, and circuit breaker 204 may be chosen according to particular requirements, power entry apparatus 140 may be configured to deliver power to many types of electrical devices 100.

Bus bars 206 and terminal lugs 208 are arranged so that the spacing among bus bars 206 and the spacing among terminal lugs 208 is sufficient to prevent any electrical interference among the currents passing through terminal lugs 208 and bus bars 206. A phenomenon known as creepage occurs when a current in a first conductor affects a current in a second conductor located too close to the first conductor. In one embodiment of the present invention, the spacing among bus bars 206 and terminal lugs 208 is selected to prevent creepage from occurring for the electrical current levels expected during operation of electrical device 100. Various safety codes including the UL safety standard also set forth minimal spacings between conductors. In one embodiment of the present invention the spacing among the bus bar 206 and spacing among terminal lugs 208 meet or exceed the safety code requirements. Moreover, spacers 225 on base plate 202 provide further isolation for each bus bar 206 and terminal lug 208.

The power inputs of circuit breaker 204 receive electrical power from bus bars 206. When circuit breaker 204 is in a closed position, the electrical power is output by the power outputs (not shown) of circuit breaker 204. The power outputs may be connected to the chassis or other component of electrical device 100, thereby providing electrical power to electrical device 100. Circuit breaker 204 may be of various sizes and electrical ratings. In one embodiment of the present invention, circuit breaker 204 is selected according to the electrical needs of electrical device 100. By providing circuit breaker 204 in power entry apparatus 140, a safe, reliable, and accessible method to stop power from entering electrical device 100 is achieved.

Face plate 210 may be constructed of any material sufficient to withstand the heat that will be associated with the operation of power entry apparatus 140. In one embodiment of the present invention, a number of mounting screws 224 connect face plate 210 with base plate 202. Other methods of connecting face plate 210 with base plate 202 are envisioned to be within the scope of the present invention. In the illustrated embodiment, a mounting screw 224 passes through a hole in face plate 210 and is screwed into a corresponding hole in base plate 202. Face plate 210 contains an opening to permit access to circuit breaker 204 and an opening to permit access to terminal lugs 208. In one embodiment, face plate 210 is made from a conductive material, and a ground screw 226 passes through a hole in face plate 210 and is screwed into a hole in the ground bus bar 206. In this embodiment, ground screw 226 electrically connects ground bus bar 206 to face plate 210.

Base plate 202 may be constructed from any nonconductive material sufficient to withstand the heat that will be associated with the operation of power entry apparatus 140. In the illustrated embodiment, mounting screws 224 are used to connect bus bars 206 to base plate 202. In this embodiment, a mounting screw 224 passes through a hole in bus bar 206 and is screwed into a corresponding hole in base plate 202. Other methods of connecting bus bars 206 to base plate 202 are envisioned that are also within the scope of the present invention.

Cover 212 may be made from any non-conductive material of sufficient strength and durability to withstand the heat that will be associated with the operation of power entry apparatus 140. Cover 212 provides a safety shield to ensure that a person does not accidentally touch or disturb an electrical conductor. In one embodiment, cover 212 is formed from transparent plastic or similar material with sufficient strength and rigidity to prevent a person or object from coming into unintentional contact with terminal lugs 208 or bus bars 206. In this embodiment, terminal lugs 208 and bus bars 206 may be viewed with cover 212 in place. Other embodiments are envisioned where cover 212 is formed from other materials that are also within the scope of the present invention. Cover 212 includes an opening that permits access to circuit breaker 204. In one embodiment, cover 212 is secured to face plate 210 by a number of multiple mounting screws 224. In this embodiment, a mounting screw 224 passes through a hole in cover 212 and is screwed into a corresponding hole in face plate 210. This design facilitates the installation of power entry apparatus into electrical device 100, in that all conductor connections may be securely made before attaching cover 212 in the final step of the installation process. Other methods of connecting cover 212 to face plate 210 are also envisioned to be within the scope of the present invention.

Figure 3:
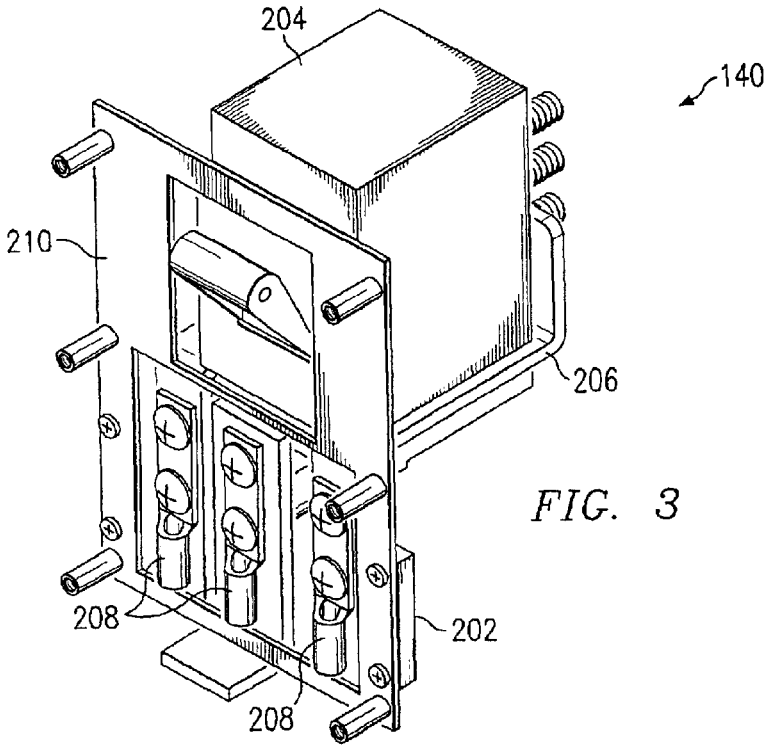
FIG. 3 illustrates a view of the assembled power entry apparatus.

FIG. 3 there shows an assembled version of power entry apparatus 140 in one embodiment of the present invention. Power entry apparatus 140 includes circuit breaker 204, bus bars 206, back plate 202, terminal lugs 208, and face plate 210. In one embodiment, power entry apparatus 140 presents a compact design that may be used with various sizes of electrical devices 100. In this embodiment of the present invention, power entry apparatus 140 meets or exceeds the industry standards for environmental and physical criteria necessary for reliable and safe operation in a central office or other telecommunications facility. The standards met or exceeded by power entry apparatus 140 include the May 2001 SBC Equipment Requirements specification TP76200MP, GR-63-Core specification, Underwriters Laboratory (UL) requirements, and all applicable Network Equipment Building Standards (NEBS). In one embodiment, base plate 202 and cover 212 are constructed from flame-retardant materials that may help to prevent a fire from damaging electrical device 100 or its surroundings.

Thus, it is apparent that there has been provided, in accordance with the present invention, a power entry apparatus for delivering electrical power from an external power source to an electrical device that satisfies the advantages set forth above. Although the present invention has been described in detail, it should be understood that various changes, substitutions, and alterations may be readily ascertainable by those skilled in the art and may be made herein without departing from the spirit and scope of the present invention as defined by the following claims.

What is claimed is:

1. A power entry apparatus, comprising:

a plurality of bus bars;

a plurality of conductor terminations exposed external to the power entry apparatus, wherein at least one of the plurality of conductor terminations is mounted to at least one of the plurality of bus bars at a plurality of mounting points;

a plurality of spacers on a base plate, attached to a face plate and the plurality of bus bars, operable to individually isolate the plurality of conductor terminations; and a circuit breaker electrically connected to the plurality of bus bars.

2. The power entry apparatus of claim 1, wherein the plurality of bus bars are spaced to prevent electrical creepage among the plurality of bus bars.

3. The power entry apparatus of claim 1, wherein at least one of the plurality of bus bars is directly connected to at least one input of the circuit breaker.

4. The power entry apparatus of claim 1, further comprising a cover that covers the plurality of bus bars and the plurality of conductor terminations.

5. The power entry apparatus of claim 4, wherein the cover is constructed from a non-conductive material that is non-flammable.

6. The power entry apparatus of claim 1, wherein the plurality of conductor terminations comprise a plurality of terminal lugs.

7. The power entry apparatus of claim 6, wherein the plurality of terminal lugs are two-hole, standard barrel terminal lugs.

8. A method for providing electrical power, comprising:

providing a plurality of bus bars;

mounting at least one of a plurality of exposed conductor terminations to at least one of the plurality of bus bars at a plurality of mounting points;

inserting spacers on a base plate, attached to a face plate and the plurality bus bars, to physically isolate the plurality of exposed conductor terminations from each other;

electrically connecting a circuit breaker to the plurality of bus bars.

9. The method of claim 8, further comprising spacing the plurality of bus bars to prevent electrical creepage among the plurality of bus bars.

10. The method of claim 8, further comprising connecting at least one of the plurality of bus bars directly to at least one input of the circuit breaker.

11. The method of claim 8, further comprising covering the plurality of bus bars and the plurality of conductor terminations with a cover constructed from a non-conductive material.

12. The method of claim 8, wherein the plurality of conductor terminations comprise a plurality of terminal lugs.

13. The method of claim 12, wherein the plurality of terminal lugs are two-hole, standard barrel terminal lugs.

14. The method of claim 8, wherein the plurality of conductor terminations comprise a positive direct current electrical connection, a negative direct current electrical connection, and a ground path connection.

15. The power entry apparatus of claim 6, further comprising:

a cover, wherein the cover is made from a non-conductive material; and a baseplate, wherein the baseplate is made from a non-conductive material.

16. The power entry apparatus of claim 15, wherein the plurality of bus bars are spaced to prevent electrical creepage among the plurality of bus bars.

17. The power entry apparatus of claim 15, wherein the plurality of terminal lugs comprise a plurality of two-hole, standard barrel terminal lugs.

18. The power entry apparatus of claim 15, wherein at least one of the plurality of bus bars is directly connected to at least one input of the circuit breaker.

19. The power entry apparatus of claim 15, wherein the cover and baseplate cover the plurality of bus bars and the plurality of terminal lugs.

20. The power entry apparatus of claim 15, wherein the plurality of terminal lugs comprise a positive direct current electrical connection, a negative direct current electrical connection, and a ground connection.

* * * * *

UNITED STATES PATENT AND TRADEMARK OFFICE

CERTIFICATE OF CORRECTION

PATENT NO. : 6,794,576 B1
DATED : September 21, 2004
INVENTOR(S) : Eric J. Justason et al.

It is certified that error appears in the above-identified patent and that said Letters Patent is hereby corrected as shown below:

Column 6,
Line 49, after "plurality", insert -- of --.

Signed and Sealed this

Seventh Day of June, 2005

JON W. DUDAS
*Director of the United States Patent and Trademark Office*